US005774947A

United States Patent [19]

Anscher

[11] Patent Number: 5,774,947

[45] Date of Patent: Jul. 7, 1998

[54] ANTI-SLIP WEBBING ADJUSTER

[75] Inventor: Joseph Anscher, Muttontown, N.Y.

[73] Assignee: National Molding Corp., Farmingdale, N.Y.

[21] Appl. No.: 971,841

[22] Filed: Nov. 14, 1997

[51] Int. Cl.[6] ..... A44B 11/00

[52] U.S. Cl. ..... 24/200; 24/171; 24/195

[58] Field of Search ..... 24/194, 196, 200, 24/68 CD, 311, 313, 318, 168, 169, 170, 171, 184

[56] References Cited

U.S. PATENT DOCUMENTS

| | | | |
|---|---|---|---|
| 3,402,439 | 9/1968 | Currat | 24/194 |
| 3,979,800 | 9/1976 | Masuda | 24/171 X |
| 4,025,991 | 5/1977 | Miner | 24/171 X |
| 4,525,901 | 7/1985 | Krauss | 24/200 |
| 4,637,099 | 1/1987 | Kasai | 24/200 |
| 4,800,626 | 1/1989 | Ikeda | 24/200 X |
| 5,100,176 | 3/1992 | Ball et al. | 24/196 X |
| 5,243,741 | 9/1993 | Fudaki et al. | 24/200 |
| 5,331,726 | 7/1994 | Suh | 24/196 X |
| 5,371,926 | 12/1994 | Van Noy et al. | 24/196 X |
| 5,651,166 | 7/1997 | Lundstedt | 24/200 |

*Primary Examiner*—Randolph A. Reese
*Assistant Examiner*—Robert J. Sandy
*Attorney, Agent, or Firm*—Collard & Roe, P.C.

[57] ABSTRACT

A device for adjusting a length of webbing, comprising a generally U-shaped body formed from two side arms connected by an end arm. A transverse bar having a gripping surface is mounted between the two side arms. A connecting device such as a buckle or hook is attached to the ends of the side arms. A pivotable plate is mounted between the two side arms and in between the transverse bar and connecting device. The pivotable plate has a gripping surface that contacts the gripping surface of the transverse bar. A release device is mounted on at least one side arm for selectively pivoting the pivotable plate. A length of webbing threaded through the device is securely held between the gripping surfaces of the transverse bar and pivotable plate until the release means is actuated. The friction from the gripping surfaces and pressure from the pivotable plate prevents the webbing from slipping out of the device even under tension from all angles. The release device permits simple adjustment of the webbing.

9 Claims, 4 Drawing Sheets

ANTI-SLIP WEBBING ADJUSTER

BACKGROUND OF THE INVENTION

1. Field of the Invention

This invention relates to an anti-slip webbing adjustor. In particular, the invention relates to a buckle or other device having a webbing adjustor with a pivoting grooved plate that grips a length of webbing and prevents the webbing from slipping, even under tension from all angles.

2. The Prior Art

Many types of buckles are used to secure two ends of a strap or length of webbing together, typically for use as safety belts, or in luggage or outerwear. Typically, these buckles have a series of transverse arms through which the webbing is threaded. These arms allow the webbing to be adjusted to fit the size of the user. When tension is applied by the strap, the strap tends to stay in place due to the friction of the strap against itself and the buckle. However, if the tension is applied perpendicular to the buckle, the friction on the strap is reduced and it can easily slide out of the buckle.

This phenomenon occurs frequently when the buckle is used as a child restraining belt in such places as high chairs. Because an infant has a very small circumference, the angle at which the tension is applied to the buckle is rarely near 180 degrees, and can often approach 90 degrees. At this point, the strap can easily slide out of the buckle and the belt is rendered ineffectual. Agitated motion by the infant while strapped into the belt can further increase the risk of slippage.

Accordingly, there have been efforts to provide a device that securely grips the strap or webbing under tension from all angles. One such device is shown in U.S. Pat. No. 5,651,166 to Lundstedt. This device has a flexible projecting member that rests against a transverse member of the buckle. The webbing is threaded in between the projecting member and the transverse member, and the tension from the projecting member keeps the webbing in place. This device has the disadvantage that once the webbing is sufficiently tightened, it cannot be easily loosened from the buckle to enlarge the belt.

Another device produced by Yoshida Kogyo K.K. (YKK) utilizes a pivoting grooved arm that grips the webbing as it is pulled tight against the buckle. The arm is a separate piece that is loosely held between the two sides of the buckle. While this device is easily adjustable, the webbing can easily slip out of the buckle if the tension is applied perpendicular to the buckle, as described above.

SUMMARY OF THE INVENTION

It is therefore an object of the present invention to provide a device for adjusting the size of a length of webbing attached to a buckle, hook or other connecting type device, that prevents slippage of the webbing even under tension from any angle.

It is another object of the present invention to provide a device for adjusting a length of webbing that allows the webbing to be easily lengthened.

It is another object of the present invention to provide a device for adjusting a length of webbing that is simple and economical to manufacture.

These and other objects of the invention are accomplished by a device for adjusting a length of webbing, comprising a generally U-shaped body formed from two side arms and an end arm. The side arms each have an end that is connected to a device such as a part of a buckle, or a hook.

A transverse bar is mounted between the two side arms and is separated from the end arm. The transverse bar has a gripping surface for increasing the friction on a length of webbing threaded through the device.

A pivotable plate is mounted between the two side arms and in between the transverse bar and the connecting device. The pivotable plate has a gripping surface contacting the gripping surface of the transverse bar, to trap the webbing between the two surfaces. A release mechanism is located on at least one side arm for selectively pivoting the pivotable plate and releasing the webbing from the gripping surfaces for adjustment.

The pivotable plate is preferably integrally formed with the connecting device via living hinges. Most preferably, the entire device is integrally formed as one unit. The device can be made out of any suitable material, such as acetal or nylon.

The release mechanism is preferably a button integrally formed with each side of pivotable plate. The buttons extend through an aperture in each of the side arms. The buttons can be moved within the aperture by a user's fingers to pivot the pivotable plate and release the webbing from between the gripping surfaces.

In an alternative embodiment, the buttons are integrally formed with the side arms via living hinges. Pressing the buttons inward toward the pivotable plate causes the buttons to slide under the pivotable plate and push the pivotable plate upwards to release the webbing from in between the gripping surfaces. To facilitate this movement, the underside of the pivotable plate has inwardly slanted flanges on either side. The buttons slide along the flanges and lift the pivotable plate up and away from the transverse bar.

The gripping surfaces comprise a plurality of longitudinally-extending grooves on the pivotable plate and transverse bar. The gripping surfaces contact the webbing and hold the webbing in place via friction from the grooves and downward pressure from the pivotable plate.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENT

Figure 1:
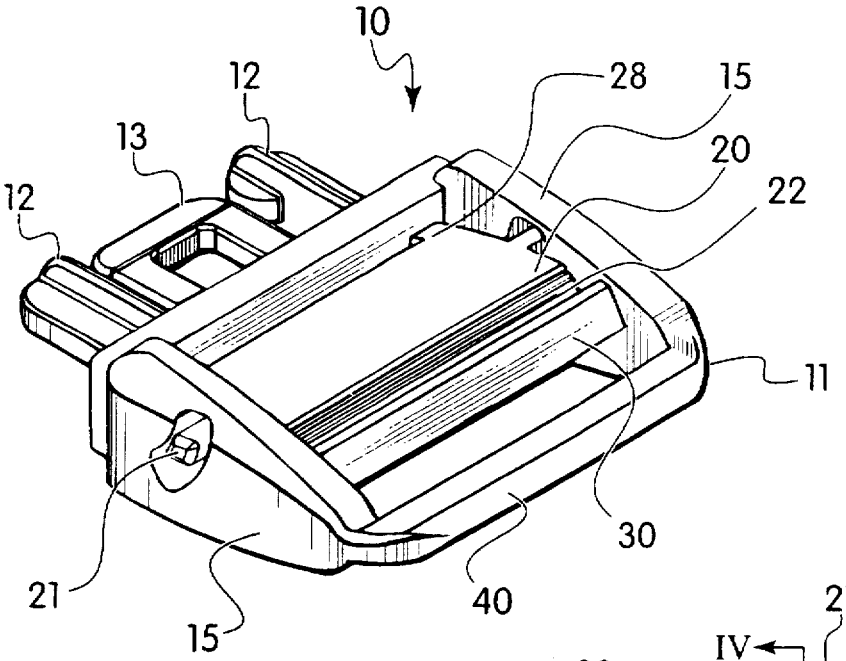
FIG. 1 is a perspective view of the device according to the invention.
Figure 2:
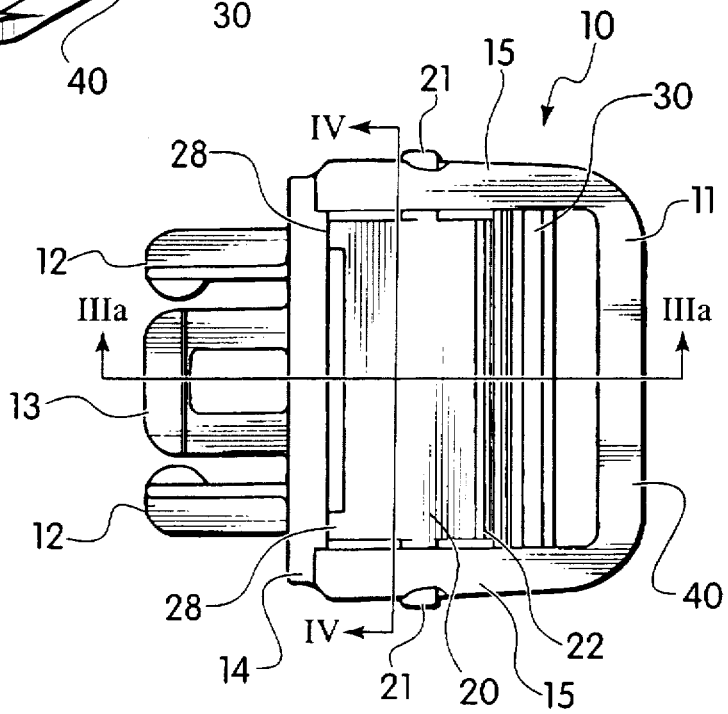
FIG. 2 is a top view of the device.

Referring now in detail to the drawings and in particular FIGS. 1—6, there is shown one embodiment of the device according to the invention. Device 10 has a U-shaped body 11 attached to one half of a buckle, which is comprised of plate 14 and locking arms 12 and 13. Body 11 has two side arms 15 integrally formed with an end arm 40. A transverse bar 30 extends between side arms 15 and is spaced from end arm 40 to create a gap for threading a length of webbing therethrough.

Figure 3A:
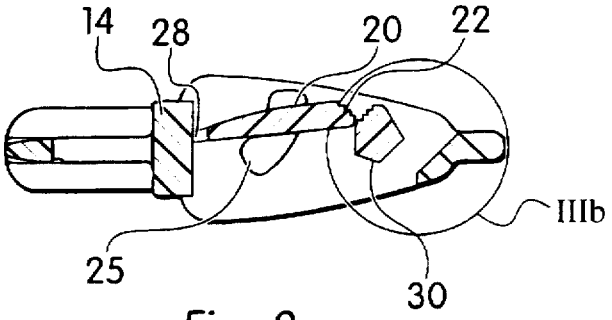
FIG. 3*a* is a cross-sectional view taken along lines IIIa—IIIa of FIG. 2.
Figure 3B:
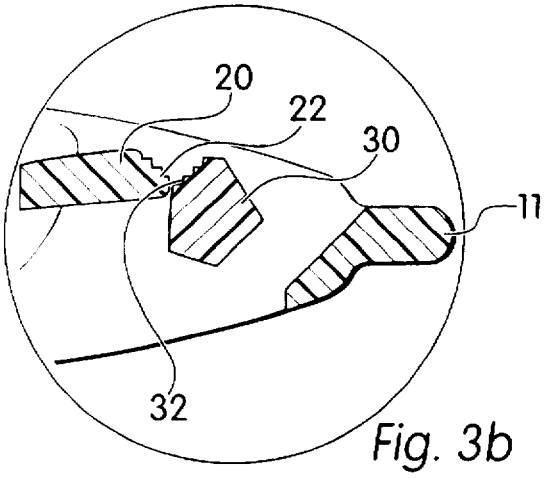
FIG. 3*b* is an enlargement of the gripping assembly of the device shown in FIG. 3*a;*
Figure 3C:
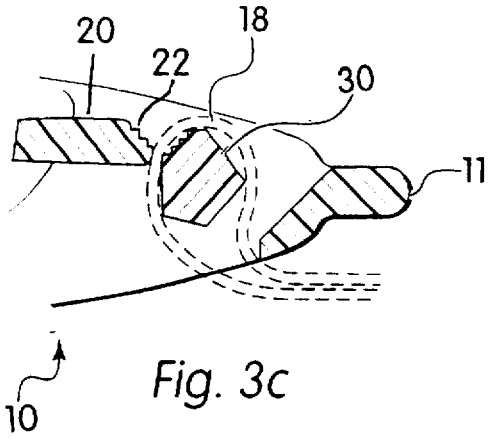
FIG. 3*c* is a cross-sectional view of the device with a length of webbing threaded therethrough.

A pivotable plate 20 is connected to plate 14 via living hinges 28. Pivotable plate 20 contacts transverse bar 30 so that a piece of webbing threaded in between pivotable plate 20 and transverse bar 30 is securely held in between. Transverse bar 30 is equipped with a grooved gripping surface 32, which is shown in FIG. 3*b*. Pivotable plate 20 is also equipped with a grooved gripping surface 22, shown in FIG. 3*b*. These grooved gripping surfaces 22 and 32 provide additional gripping power to pivotable plate 20 and transverse bar 30 for holding webbing 18 securely in between, as shown in FIG. 3*c*. Pivotable plate 20 is formed so that in its resting position, it contacts transverse bar 30 to grip webbing 18.

Figure 4:
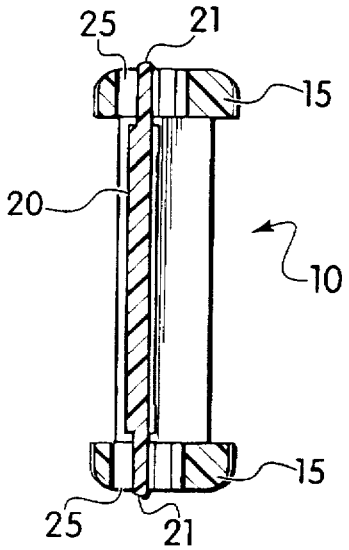
FIG. 4 is a cross sectional view taken along lines IV—IV of FIG. 2.
Figure 5:
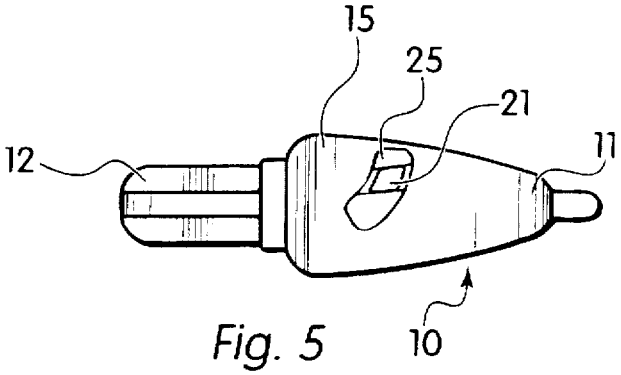
FIG. 5 is a side view of the device shown in FIG. 1.
Figure 6:
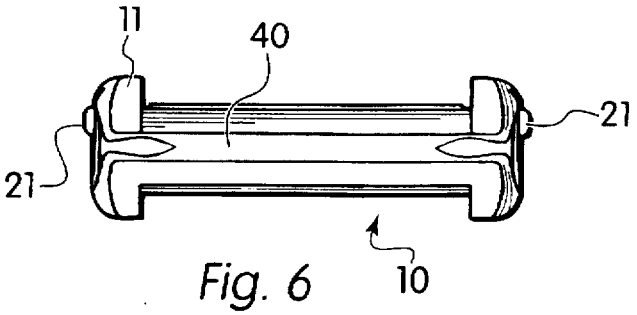
FIG. 6 is an end view of the device shown in FIG. 1.
Figure 7:
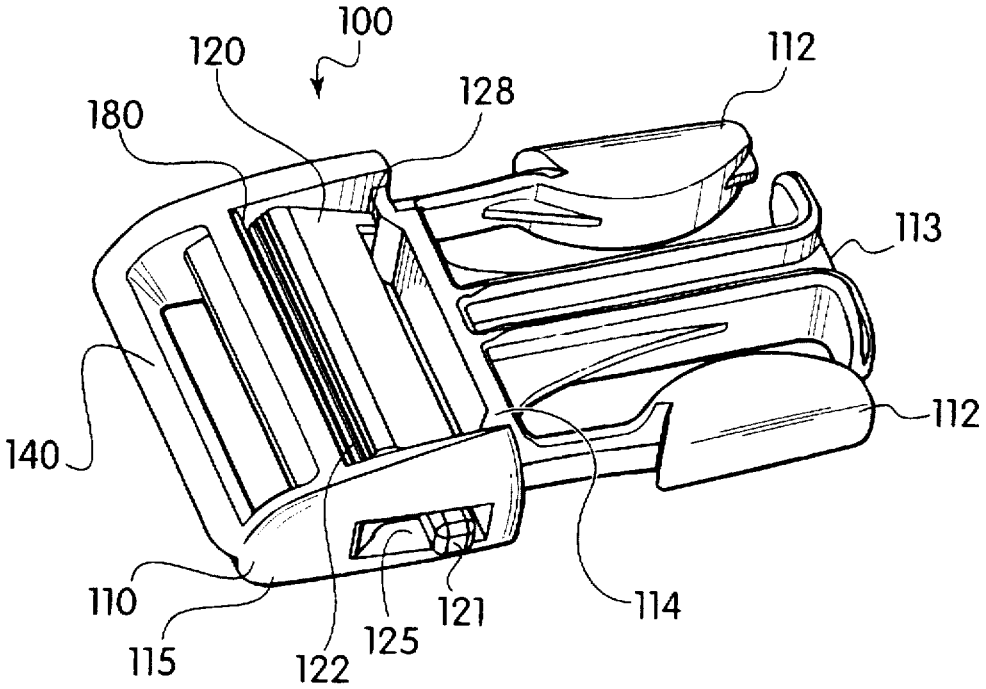
FIG. 7 is a perspective view of an alternative embodiment of the device according to the invention.
Figure 8:
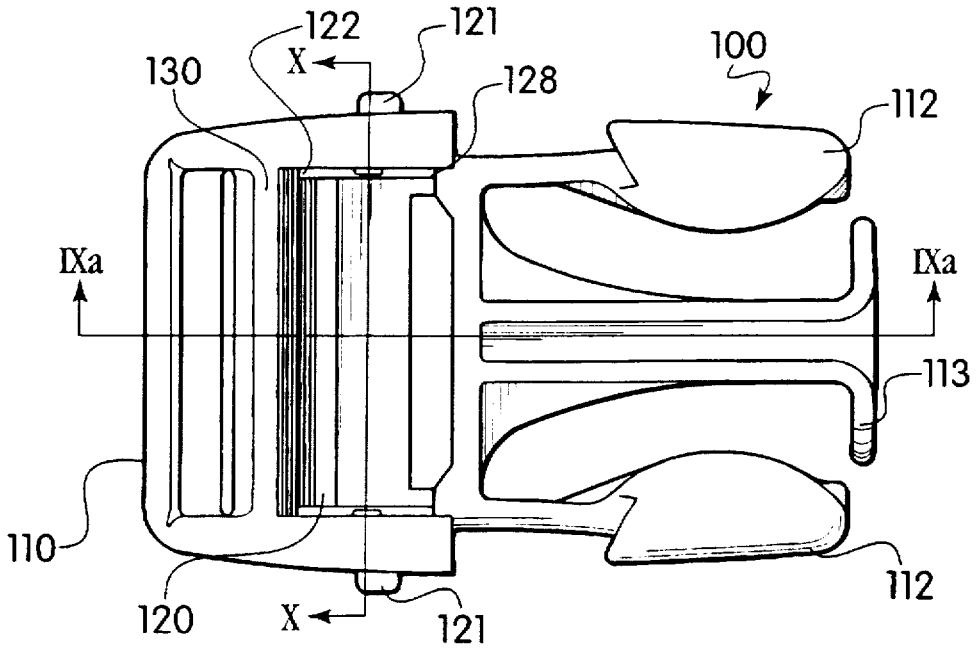
FIG. 8 is a top view of the device as shown in FIG. 7.
Figure 9A:
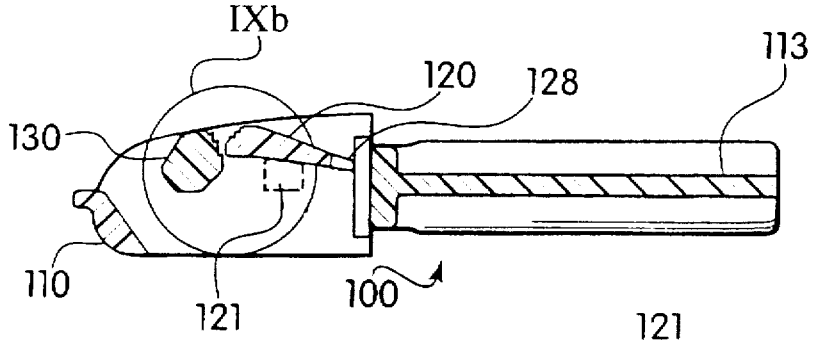
FIG. 9*a* is a side cross-sectional view taken along lines IX—IX of FIG. 8.
Figure 9B:
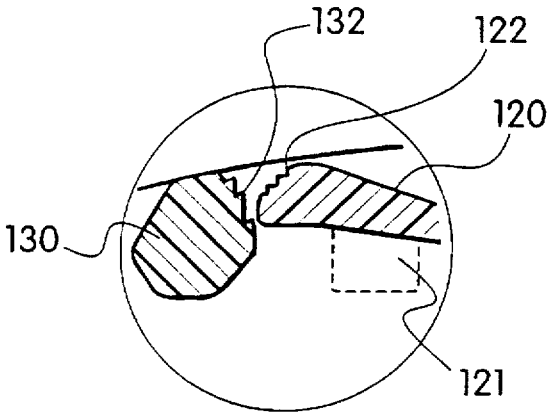
FIG. 9*b* is an enlarged view of the gripping elements shown in FIG. 9*a;*

Pivotable plate 20 is integrally formed with two buttons 21, which extend through apertures 25 in side arms 15, as shown in FIG. 4. Buttons 21 allow a user to pivot plate 20 upwards with their fingers, and free a length of webbing that is held between plate 20 and transverse bar 30. This way, the webbing can be easily adjusted by simply lifting pivotable plate 20 via buttons 21. At all other times, the webbing is securely held between gripping surfaces 22 and 32 so that the webbing does not slip out of device 10, even under tension from all angles.

An alternative embodiment of the device according to the invention is shown in FIGS. 7—12. Device 100 comprises a generally U-shaped body 110, having two side arms 115 connected by an end arm 140. A transverse bar 130 is mounted in between side arms 115 and spaced from end arm 140 to define a gap for receiving a length of webbing.

A pivotable plate 120 is integrally formed with plate 114 via living hinges 128. Pivotable plate 120 rests against transverse bar 130 to grip a piece of webbing in between. Pivotable plate 120 and transverse bar 130 each have grooved gripping surfaces 122 and 132, respectively, to increase the frictional grip on the webbing.

Figure 10:
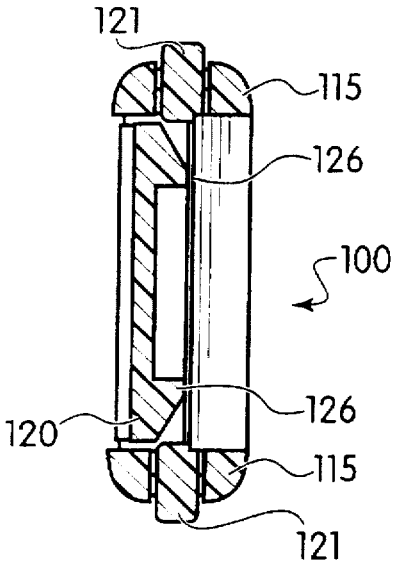
FIG. 10 is an end cross-sectional view taken along lines X—X of FIG. 8.
Figure 11:
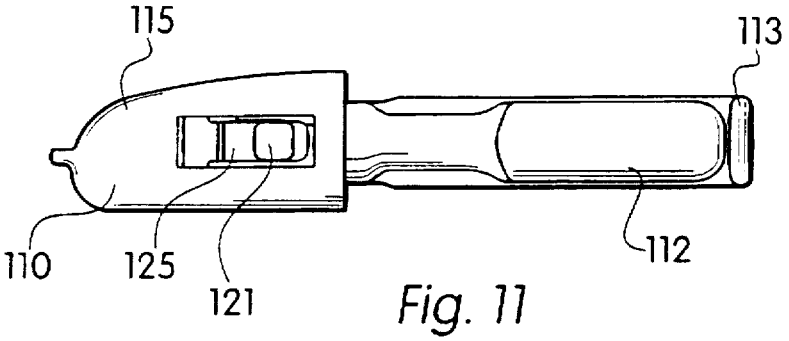
FIG. 11 is a side view of the embodiment shown in FIG. 7.
Figure 12:
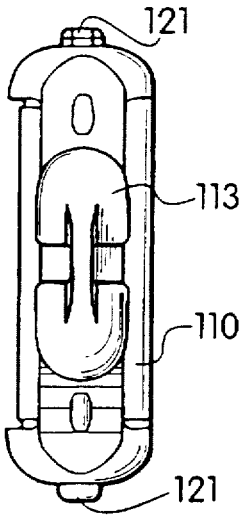
FIG. 12 is a side view of the embodiment shown in FIG. 7.

Two buttons 121 are flexibly mounted on sides 115 of device 11. Buttons 121 are integrally formed with sides 115 via living hinges 125, and are adapted to be pressed inward by a user's fingers. Pivotable plate 120 has downwardly-extending, inwardly sloped flanges 126, as shown in FIG. 10. Pressing buttons 121 inward causes buttons 121 to slide along flanges 126 and lift plate 120 upwards to release any contact with transverse bar 130. Thus, a length of webbing threaded in between plate 120 and transverse bar 130 can be easily adjusted by merely pressing buttons 121.

The present invention is a significant improvement over the prior art, because even when a strap is rotated so that tension is exerted perpendicular to the device, the gripping surfaces hold the strap firmly in place and no slippage occurs. The present invention also provides for very simple strap adjustment as well.

Accordingly, while only two embodiments of the present invention have been shown and described, it is obvious that many changes and modifications may be made thereunto without departing from the spirit and scope of the invention.

What is claimed is:

1. A device for adjusting a length of webbing, comprising:

a generally U-shaped body comprising two side arms connected by an end arm, said side arms each having an end;

a connecting device attached to the ends of the side arms;

a transverse bar mounted between the two side arms and separated from the end arm, said transverse bar having a gripping surface;

a pivotable plate mounted between the two side arms and in between said transverse bar and said connecting device, said pivotable plate having a gripping surface contacting the gripping surface of said transverse bar; and release means on at least one side arm for selectively pivoting said pivotable plate, wherein a length of webbing threaded through said device is securely held between the gripping surfaces of said transverse bar and said pivotable plate until said release means is actuated.

2. The device according to claim 1, wherein said pivotable plate is integrally formed with said connecting device via at least one living hinge.

3. The device according to claim 1, wherein said release means is a button integrally formed with said pivotable plate and extending through an aperture in one of said side arms, and wherein said button can be moved within said aperture to pivot said pivotable plate.

4. The device according to claim 3, wherein said release means further comprises a second button integrally formed with the pivotable plate and extending through an aperture in the other of said side arms.

5. The device according to claim 1, wherein said gripping surfaces comprise a plurality of grooves formed on the pivotable plate and transverse bar.

6. The device according to claim 1, wherein the release means comprises a button connected to each of said side arms, and wherein pressing said buttons pivots said pivotable plate to release the webbing held between the gripping surfaces.

7. The device according to claim 6, wherein said buttons are integrally formed with the side arms via living hinges.

8. The device according to claim 6, wherein the pivotable plate has inwardly sloping side flanges, and wherein said buttons contact said side flanges as said buttons are pressed inward, and slide along said flanges to raise said pivotable plate.

9. The device according to claim 1, wherein the connecting device comprises a buckle.

* * * * *